United States Patent [19]

Hethcoat

[11] Patent Number: 4,986,471

[45] Date of Patent: Jan. 22, 1991

[54] REMOTE INDICATOR LIGHT AND SAFETY SHIELD FOR ELECTROSTATIC SPRAY GUN

[75] Inventor: Gary L. Hethcoat, Ontario, Calif.

[73] Assignee: General Dynamics Corp., Air Defense Systems Div., Pomona, Calif.

[21] Appl. No.: 375,422

[22] Filed: Jul. 3, 1989

[51] Int. Cl.[5] ..... B05B 5/025

[52] U.S. Cl. ..... 239/3; 239/71; 239/691; 324/452; 324/457; 340/649; 361/215

[58] Field of Search ..... 239/3, 691, 708, 71; 361/212, 215, 227, 228; 324/452, 454, 457; 340/649

[56] References Cited

U.S. PATENT DOCUMENTS

| | | | |
|---|---|---|---|
| 2,552,678 | 5/1951 | Hirbec . | |
| 3,009,441 | 11/1961 | Juvinall | 239/691 |
| 3,037,703 | 6/1962 | Croskey | 361/228 |
| 3,260,616 | 7/1966 | Brewer . | |
| 3,698,635 | 10/1972 | Sickles | 239/3 |
| 4,084,134 | 4/1978 | Nagano . | |
| 4,349,783 | 9/1982 | Robson et al. . | |
| 4,370,616 | 1/1983 | Williams | 324/457 |
| 4,475,141 | 10/1984 | Antonevich | 361/212 |
| 4,586,657 | 5/1986 | Johnson et al. | 239/691 |
| 4,639,825 | 1/1987 | Breidegam | 361/212 |
| 4,682,735 | 7/1987 | Mommsen | 239/691 |

*Primary Examiner*—Andres Kashnikow
*Assistant Examiner*—Michael J. Forman
*Attorney, Agent, or Firm*—Henry Bissell; Leo R. Carroll

[57] ABSTRACT

A safety harness for use with an electrostatic spray paint gun is disclosed which fits over the feed tube and the barrel of a standard electrostatic spray gun and acts both to protect the hand of the spray gun operator from an electrostatic discharge and to provide an indication of the electrostatic operation of the spray gun. A T-shaped safety shield made of non-conductive material is placed over the portions of the spray gun which may develop an electrostatic charge thereon, and is held onto the spray gun by mating strips of material. Located on the inner surface of the safety shield is a thin sheet of conductive foil which acts to channel the discharge through a wire to illuminate an indicator light located remote from the spray gun in a highly visible position.

34 Claims, 2 Drawing Sheets

FIG. 2
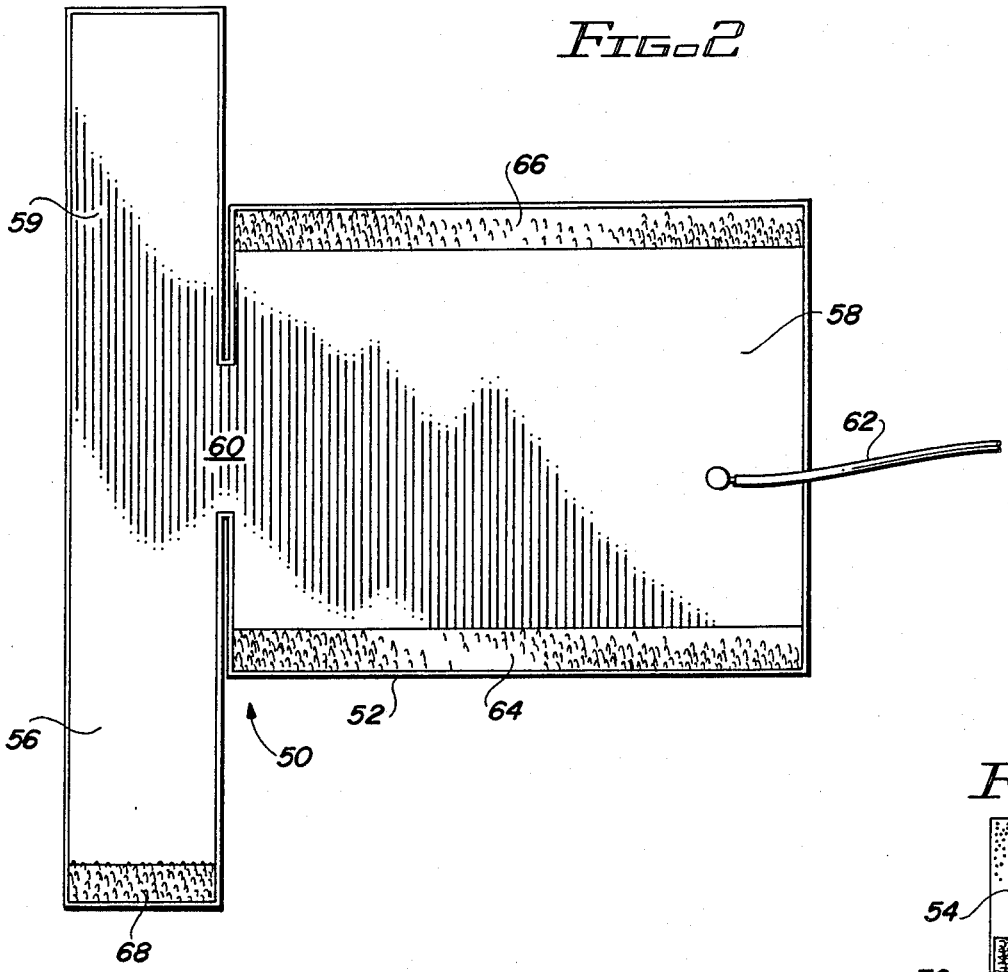
FIG. 3
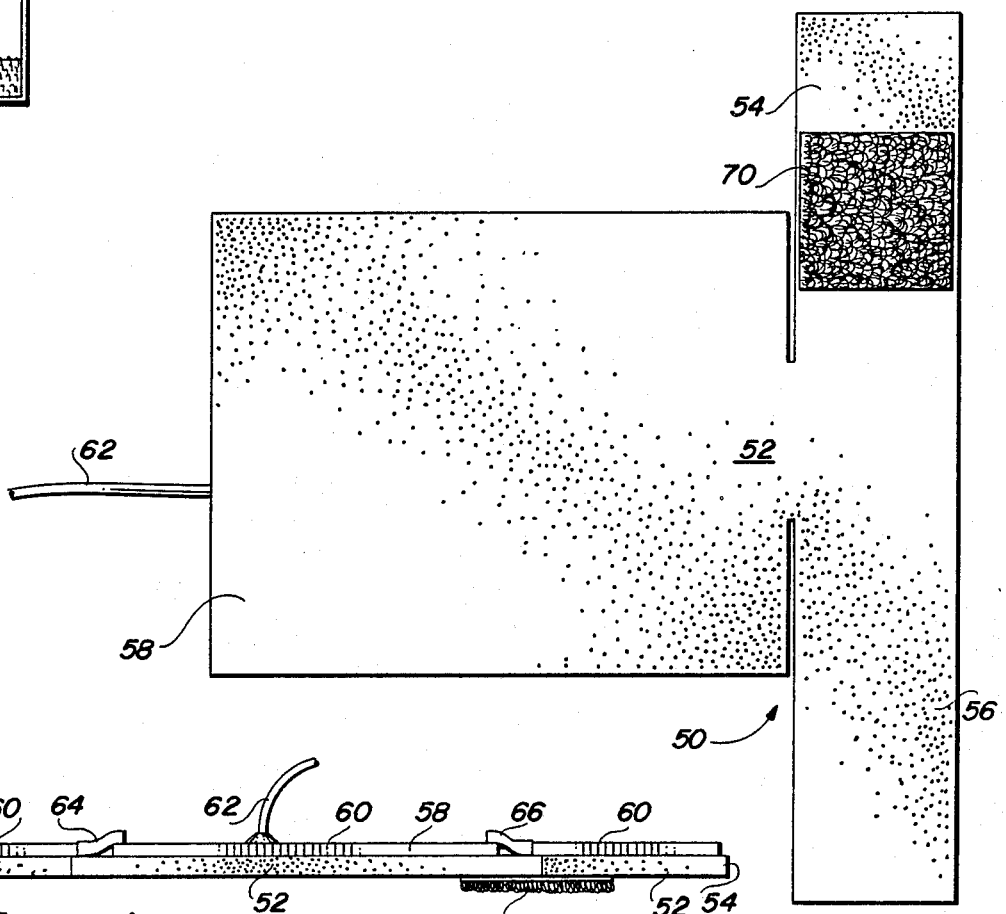
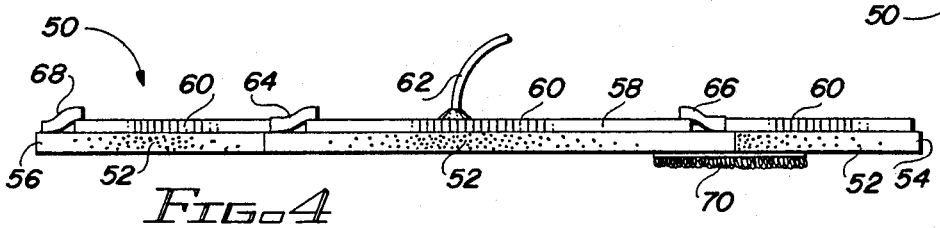
FIG. 4

REMOTE INDICATOR LIGHT AND SAFETY SHIELD FOR ELECTROSTATIC SPRAY GUN

BACKGROUND OF THE INVENTION

1. Field of the Invention.

The present invention relates generally to electrostatic paint spraying equipment, and more particularly to an apparatus which fits over the feed tube and the barrel of a standard electrostatic spray gun and acts both to protect the hand of the spray gun operator from an electrostatic discharge and to channel the discharge to an indicator light installed in a prominent place, illuminating the indicator light and providing an indication of operation of the electrostatic spray gun.

2. Description of the Related Art.

Electrostatic spray guns provide particular advantage in a spray painting operation in which a conductive article is to be painted. The article to be painted is grounded, and a strong electrostatic field is developed between paint emanating from the spray gun and the article. The electrostatic field is typically created by installing an electrode on or near the spray gun, with the electrode desirably being located in the vicinity of the atomization orifice in the nozzle of the spray gun.

The typical electrode has a tip which forms an abrupt discontinuity such as a sharp needle or a keen edge. Such a sharp discontinuity will enable the formation of the highest electrostatic field intensity in the environs of the discontinuity. By placing the tip of the electrode having the sharp discontinuity in the vicinity of the atomization orifice in the nozzle of the spray gun, the atomized paint particles will thus be subjected to this maximum electrostatic field intensity. This effectively operates to charge the atomized paint particles with respect to the article being painted.

The spray gun operates to generate a fine mist of atomized paint particles emanating from the atomization orifice in the nozzle of the spray gun. Typically, atomization may be accomplished through impinging jets of high velocity air acting on an emitted column of paint, or by very high hydraulic pressure forcing the paint through a highly restricted atomization orifice. In either event, the finely atomized paint particles are sprayed from the atomization orifice in close proximity to the tip of the electrode having the sharp discontinuity to charge the atomized paint particles.

The fact that the finely atomized paint particles are highly charged with respect to the article being painted provides an attractive force between the paint particles and the article. This results in two advantages, the first of which is that since the paint is attracted to the article being painted, there will be less overspray and less wasted paint. The other advantage is that the paint particles will form a highly uniform coating on the article being painted, thus resulting in a high quality finished appearance which is highly desirable.

It will of course be realized by those skilled in the art that the electrostatic field represents a very high voltage potential. The electrostatic field affects portions of the spray gun at times by causing voltage to build up on portions of the spray gun such as the paint supply tube between the nozzle of the spray gun and the base of the handle of the spray gun, or on the barrel of the spray gun. When sufficient voltage builds up on one of these portions of the spray gun, a discharge may arc from the charged portion of the spray gun to the operator's hand. To say the least, this is an unpleasant experience which is highly undesirable, and which may well be hazardous.

It is accordingly the primary objective of the present invention that it protect the operator from discharge arcs occurring as a result of voltage buildup on portions of the spray gun. It is of course desirable that the operation of the present invention represent a complete protection of the operator to the greatest extent possible. As such it is a further objective that the operation of the present invention act to prevent charge from building up on the portions of the spray gun over a period of time to an extremely high potential.

One of the other problems encountered in the field of electrostatic spray painting is that it is desirable to provide an indication that the electrostatic operation is functioning properly. It will be realized by those skilled in the art that the electrostatic field generated is invisible, and that only a highly experienced operator can detect when the electrostatic field is not being generated. In the past various voltage indicators have been incorporated into the design of power supplies. Unfortunately, the problem usually occurs separately from the power supply, in the spray gun itself.

There has been one significant attempt to solve this problem, which is shown in U.S. Pat. No. 4,682,735, to Mommsen. The Mommsen invention incorporates an indicator light into the spray gun itself, with one side of the indicator light being grounded and the other side being placed in proximity to the electrostatic field being generated by the spray gun. When the light is illuminated, it is thus ascertained that the electrostatic operation of the spray gun is working properly.

In actual operation, the Mommsen light may not be highly visible to the operator, and thus may not be easily observed. In addition, many users of electrostatic paint guns will employ a protective cover on the spray gun to protect it from overspray. Such a cover will be placed over the Mommsen light, thus effectively preventing it from providing its highly useful signal to the operator. Finally, it will be realized that the signal provided by the Mommsen design that the electrostatic operation of the spray gun is functioning properly is visible only to the operator in the spray booth.

It is thus an additional objective of the present invention that it provide a more visible signal that the electrostatic operation is in fact functioning properly. The signal should be located away from the spray gun so that a protective cover placed over a portion of the spray gun will not obstruct the signal. In addition, the signal should be visible not only to the operator of the spray gun, but it should be visible to others without entering the spray painting booth.

Both the protection accorded to the operator from electrical discharge and the more visible signal of proper electrostatic operation should be accomplished in as expeditious a manner as possible. The improvements of the present invention should be obtained at as low a cost as possible, thereby making the solution of the present invention highly desirable from an economic standpoint. Finally, it is also an objective of the present invention that all of the aforesaid advantages and objectives be achieved without incurring any substantial relative disadvantage.

SUMMARY OF THE INVENTION

In one particular arrangement in accordance with the present invention, a safety shield made of non-conductive material is placed over both the paint supply tube between the nozzle of the spray gun and the base of the handle of the spray gun, and on the barrel of the spray gun. The safety shield is made of a T-shaped segment of material, and is held onto the barrel and the paint supply tube by Velcro-type material (Velcro being a trademark) in the form of releasable self-attaching strips.

This material is essentially a male and female type of fastener, with the female portion being a strip of material with curly strands or loops of material on the outer surface, and the male portion being a strip of material with a large number of flexible resilient plastic hooks on the outer surface, as illustrated in U.S. Pat. No. 3,063,718, to Steincamp. When the male and female strips of material are pressed against one another, the hooks in the male strip become entangled with the loops in the female strip, retaining the two strips together until they are forced apart.

Located on the inner surface of the safety shield facing the barrel and the paint supply tube is a thin sheet of conductive foil. A wire is attached to the thin sheet of foil, and exits the safety shield near the base of the handle of the spray gun. The wire may be run together with the paint supply hose and the power supply cable. The wire leads to one side of an indicator light which is located remote from the spray gun, the other side of the indicator light being grounded. In the preferred embodiment, the indicator light is located above the spray painting booth, where it will be visible both to the operator and to people outside the spray painting booth.

In operation, as the spray gun is operated in its electrostatic mode, electrostatic charge will build up on the paint supply tube between the nozzle of the spray gun and on the base of the handle of the spray gun, and on the barrel of the spray gun if it is metal. The safety shield will protect the operator from a discharge arcing from the paint supply tube or the barrel of the spray gun to the operator's hand. The electrostatic charge will also be drained off through the wire as it builds up, and will be dissipated by illuminating the indicator light.

It may therefore be seen that the present invention teaches an apparatus which protects the operator from discharge arcs occurring as a result of voltage buildup on portions of the spray gun The operation of the present invention represents a complete protection of the operator to the greatest extent possible. As such it also acts to prevent charge from building up to an extremely high potential on the portions of the spray gun over a period of time by draining the charge away to operate a signal light, which is the other feature of the present invention.

According to this feature, a more visible signal that the electrostatic operation is in fact functioning properly is provided. The signal may be advantageously located away from the spray gun so that a protective cover placed over a portion of the spray gun will not obstruct the signal. In addition, the signal is visible not only to the operator of the spray gun, but also to others without them entering the spray painting booth.

Both the protection accorded to the operator from electrical discharge and the more visible signal of proper electrostatic operation are accomplished in an expeditious manner. The improvements of the present invention are obtained at a very low cost, thereby making the solution of the present invention highly desirable from an economic standpoint. Finally, all of the aforesaid advantages and objectives are achieved without incurring any substantial relative disadvantage.

DESCRIPTION OF THE DRAWING

A better understanding of the present invention may be realized from a consideration of the following detailed description, taken in conjunction with the accompanying drawing, in which:

FIG. 2 is a plan view from the inside of the safety harness of the present invention showing the conductive foil sheet, and several portions of Velcro-type material used to hold the safety harness on the spray gun shown in FIG. 1;

FIG. 3 is a plan view from the outside of the safety harness shown in FIG. 2, showing an additional portion of Velcro-type material;

FIG. 4 is an edge view of the safety harness shown in FIGS. 2 and 3; and

DETAILED DESCRIPTION OF THE PREFERRED EMBODIMENT

Figure 1:
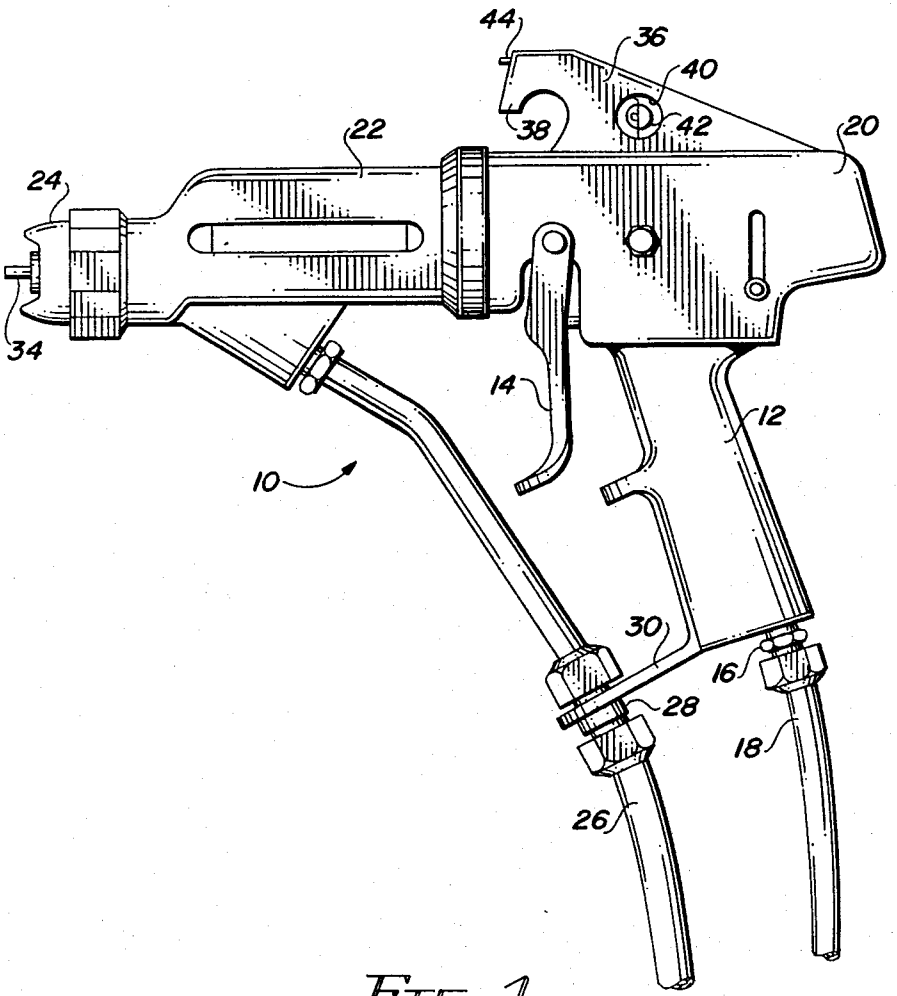
FIG. 1 is a side view of an electrostatic spray gun, showing the paint supply tube and the barrel of the spray gun on which an electrostatic charge may build up, and also showing an indicator light built into the spray gun.

Before discussing the preferred embodiment of the present invention, it is helpful to discuss the construction and operation of a typical manual electrostatic spray gun 10, which is shown in FIG. 1. The spray gun 10 has a handle 12 adapted for gripping by the hand of an operator, and a trigger 14 which is placed for actuation by the index finger of the hand of an operator. The handle 12 is typically made of a conductive material, and is grounded through a connection made by an electrical connector 16 located at the base of the handle 12 to a cable 18 containing a plurality of insulated conductors (not shown) therein.

The spray gun 10 has a body 20 mounted at the top of the handle 12, and a barrel 22 which projects from the front of the body 20. The body 20 may be made either of conductive or nonconductive material; if the body 20 is made of conductive material, it is typically grounded together with the handle 12 via the connection to the cable 18. The barrel 22 is preferably made from a nonconductive material to insulate the handle 12 and the body 20 from the portion of the spray gun 10 carrying the electrode, although in some spray guns it is conductive.

Located at the front of the barrel 22 is a nozzle 24 having an atomization orifice therein. Liquid paint is supplied through a paint hose 26 connected to the spray gun 10 using a paint connector 28 located on a projection 30 from the handle 12. A paint tube 32 generally made of conductive material provides a channel for the liquid paint from the paint connector 28 to the interior of the barrel 22.

Atomization of the liquid paint emitted from the nozzle 24 may be accomplished through either of two ways well known in the art. Specifically, impinging jets of high velocity air supplied through the cable 18 may be brought to act on an emitted column of paint whenever the trigger 14 is pulled. Alternately, very high hydraulic pressure may be used to force the paint through a highly restricted atomization orifice in the nozzle 24 when the trigger 14 is pulled, with the hydraulic pressure being generated through electromechanical means (not shown) powered electrically through conductors in the cable 18.

The spray gun 10 thus operates to generate a fine mist of atomized liquid paint particles from an atomization orifice in the nozzle 24 of the spray gun 10. A needle electrode 34 protrudes in front of the nozzle 24, and is connected to a source of electrostatic high voltage. The electrostatic high voltage may alternatively be developed internally in the spray gun 10, or externally of the spray gun 10 and supplied via a conductor in the cable 18 to the spray gun 10 and through an internal connector (not shown) to the needle electrode 34.

The termination of the electrostatic high voltage is the relatively sharp discontinuity of the needle electrode 34, which is in close proximity to the atomized liquid paint sprayed from the nozzle 24. The atomized particles of liquid paint will thus be charged with the electrostatic high voltage, and will be attracted to the grounded article being painted (not shown).

The spray gun 10 has a bracket 36 connected to the top of the body 20, which bracket 36 has a hook 38 at the front thereof for use in hanging the spray gun 10 when it is not in use. An aperture 40 is located in the bracket 36, and an indicator light 42 in located in the aperture. One side of the indicator light 42 is grounded, and the other side is connected to a terminal 44 which extends forward from the front of the bracket 36. The terminal 44 is in the vicinity of the electrostatic voltage intensity generated from the needle electrode 34.

In operation of the spray gun 10, it will be realized by those skilled in the art that the primary electrostatic field is developed between the atomized liquid paint particles which are electrostatically charged by the needle electrode 34 and the article being painted (not shown). A secondary electrostatic field is also developed between the needle electrode 34 and the grounded portions of the spray gun 10. This secondary electrostatic field is sufficient to light the indicator light 42; this is the heart of the Mommsen patent referred to above.

Unfortunately, it will be realized by those skilled in the art that the indicator light 42 can only be seen by the operator of the spray gun 10, and then only when he is looking for it. There is no indication provided by the indicator light 42 to someone outside a spray painting booth (not shown) in which the spray gun 10 is being used that the spray gun 10 is indeed in use. In addition, as mentioned above it is common for a protective cover (not shown) to be placed over portions of the spray gun 10 including the bracket 36 and the indicator light 42 to protect these portions from overspray.

In addition, it is common for the electrostatic charge associated with the secondary electrostatic field described above to build up on the paint tube 32 during operation of the spray gun 10. It will be appreciated that the operator's hand (not shown) is grasped around the grounded handle 12, and periodically the electrostatic charge which builds up on the paint tube 32 will arc to the operator's hand. This is quite painful, and is virtually unavoidable with the spray gun 10 or any of the other spray guns known in the art.

The preferred embodiment of the present invention is illustrated in FIGS. 2 through 4, which show a safety harness 50 adapted for installation on the spray gun 10, or any of the other spray guns known in the art. The safety harness 50 is T-shaped, with the broad base of the T being sufficiently wide to encompass the paint tube 32 of the spray gun 10 (FIG. 1), and the arms of the T being adapted to be wrapped around a portion of the barrel 22 of the spray gun 10 (FIG. 1).

The outer surface of the safety harness 50 is a T-shaped insulating safety shield 52 made of nonconductive material. The edges of the insulating safety shield 52 define the perimeter of the safety harness 50. The arms 54 and 56 of the T forming the safety harness 50 are attached to the base 58 of the T at the central portion of the T; the portions of the top of the base 58 of the T adjacent the sides of the base of the T are not attached to the arms 54 and 56 of the T. As such, the width of the portion of the base 58 of the T which is attached to the arms 54 and 56 of the T is only approximately a third of the width of the base 58 of the T.

The insulating safety shield 52 forms the outer surface of the safety harness 50, and as such is the portion of the safety harness 50 which will protect the hand of the operator by preventing an arc from jumping from the paint tube 32 of the spray gun 10 (FIG. 1) to the operator's grounded hand. Therefore, the material that the insulating safety shield 52 is made of must be a good insulator. In the preferred embodiment the insulating safety shield 52 may be made of materials such as neoprene, vinyl, or nonconductive rubber.

Located on the side of the insulating safety shield 52 which is the inner surface of the safety harness 50 is a thin sheet of conductive foil 60. The conductive foil 60 is preferably made of material which is both a good conductor and highly flexible, such as copper. The conductive foil 60 stays within the perimeter of the insulating safety shield 52, and is adhesively secured to the insulating safety shield 52 using an adhesive which is highly flexible, such as silicone rubber.

One end of a conductive wire 62 is soldered onto the conductive foil 60 near the bottom of the base 58 of the T, and the wire 62 extends from the base 58 of the T. Holding means are needed to secure the safety harness 50 to the spray gun 10 (FIG. 1). The preferred embodiment uses mating male and female strips, best known as Velcro-type strips. As mentioned above, the female strip is covered with curly strands or loops of material, and the male strip has a large number of flexible resilient plastic hooks thereon. When the male and female strips are pressed against one another, the hooks in the male strip become entangled with the loops in the female strip, retaining the two strips together until they are forced apart. The force to separate the male and female strips is much higher than the force required to press them together.

Three mating strips are placed on the interior surface of the safety harness 50, with the fourth mating strip being placed on the outer surface of the safety harness 50. A male strip 64 is adhesively mounted on one side of the base 58 of the T on the interior surface of the safety harness 50. A female strip 66 is adhesively mounted on the other side of the base 58 of the T on the interior surface of the safety harness 50. A male strip 68 is adhesively mounted on the outer edge of the arm 56 of the T on the interior surface of the safety harness 50. Finally, a wide female strip 70 is mounted in an intermediate position on the arm 54 of the T on the exterior surface of the safety harness 50.

Figure 5:
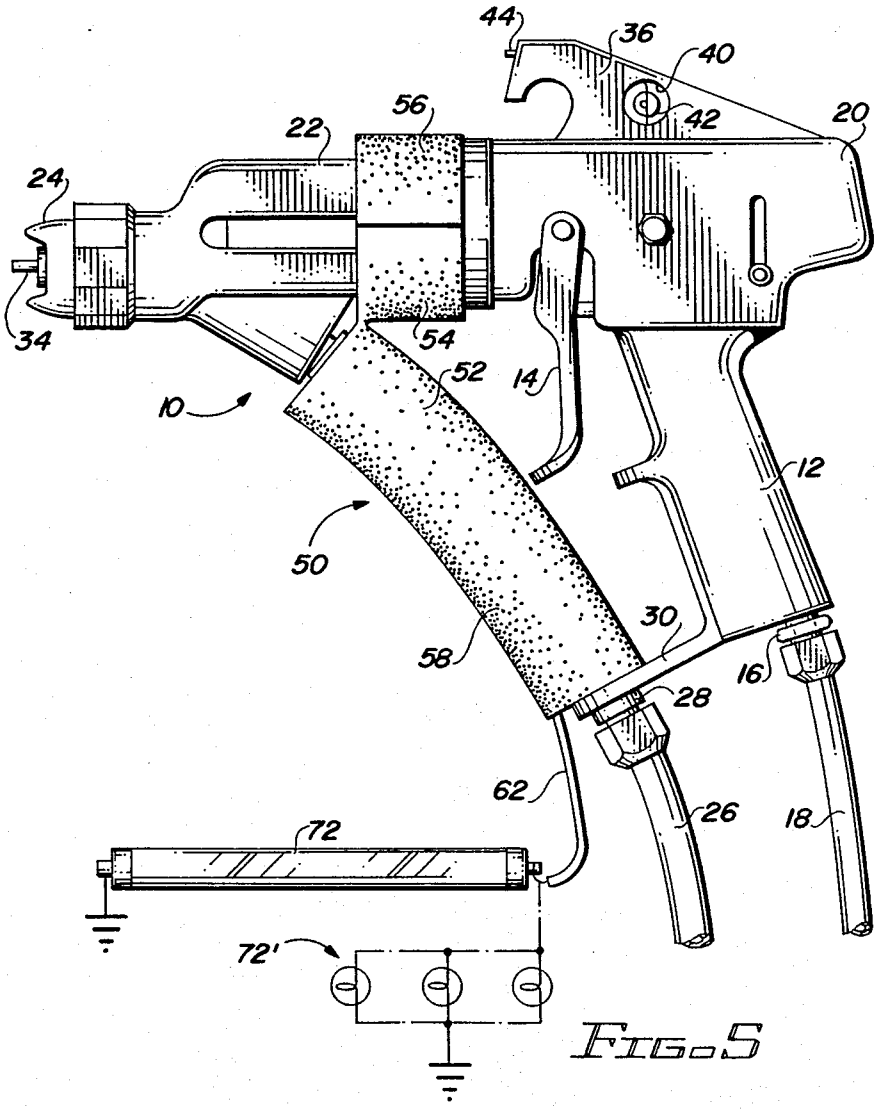
FIG. 5 is a side view of the electrostatic spray gun shown in FIG. 1 with the safety harness shown in FIGS. 2 through 4 attached thereto, and also showing in schematic fashion the connection to the indicator lamp.

The installation of the safety harness 50 onto the spray gun 10 is illustrated in FIG. 5, with reference also being made to FIGS. 1, 2, and 3 during the following description of the installation of the safety harness 50. The interior surface of the base 58 of the T is placed around the paint tube 32 with the edges of the base 58 of the T facing forward. The arms 54 and 56 of the T are wrapped around the barrel 22 from the bottom.

The arm 54 of the T is wrapped around the barrel 22 first, followed by the arm 56 of the T being wrapped around over a portion of the arm 54 of the T. This will bring the male strip 68 into mating contact with the wide female strip 70, retaining the arms 54 and 56 of the T in position around the barrel 22. The interior surfaces of the sides of the base 58 of the T are brought together, bringing the male strip 64 into mating contact with the female strip 66. This retains the base 58 of the T in position around the paint tube 32.

Due to the inherent force required to pull mated Velcro strips apart, the safety harness 50 will be secured to the spray gun 10 with a force well sufficient to prevent inadvertent removal of the safety harness 50 from the spray gun 10. However, to remove the safety harness 50 from the spray gun 10 it is necessary only to pull the male strip 64 and the female strip 66 apart, releasing the base 58 of the T, and then to pull the male strip 68 and the wide female strip 70 apart, releasing the arms 54 and 56 of the T. Of course, it will be recognized that the male strips 64 and 68 could instead be female strips and that the female strip 66 and the wide female strip 70 could instead be male strips without departing at all from the present invention, since the description above is given by way of example only.

Similarly, it should be noted that one of the male strip 64 and the female strip 66 could be located on the exterior of the surface of the safety harness 50. In this case, rather than pressing the interior surfaces of the sides of the base 58 of the T together to mate the male strip 64 and the female strip 66 together, one of the sides of the base 58 of the T would overlap the other to bring the male strip 64 and the female strip 66 together.

In completing the present invention, an indicator light 72 is connected at one side to the other end of the wire 62, and at the other side to ground. The indicator light 72 in the preferred embodiment is a fluorescent tube as shown, which is preferably located above the spray painting booth (not shown) so that it may be seen by people outside the spray painting booth as well as by the operator of the spray gun 10 when the spray gun 10 is being operated. Alternatively, the indicator light 72 may be one or more neon bulbs 72', if desired.

When the spray gun 10 is operated in an electrostatic mode, the secondary electrostatic field will be drained by the conductive foil 60 from the spray gun 10 through the wire 62, lighting the indicator light 72 to indicate that the desired electrostatic operation of the spray gun 10 is occurring. The indication provided by the indicator light 72 is superior to that provided by the indicator light 42 in the spray gun 10, being more highly visible than is the indicator light 42 in the spray gun 10.

In addition, the use of the safety harness 50 will protect the operator from the occurrence of an arc due to the secondary electrostatic field. In fact, the electrostatic charge on portions of the spray gun 10 such as the paint tube 32 will be drained off immediately as it occurs. In the process of draining the electrostatic charge off, an excellent indication of operation of the electrostatic field is also obtained.

It may therefore be appreciated from the above detailed description of the preferred embodiment of the present invention that it teaches an apparatus which effectively protects the operator from discharge arcs occurring as a result of voltage buildup on portions of the spray gun. The operation of the present invention thereby represents a complete protection of the operator to the greatest extent possible. As such it also acts to prevent charge from building up to an extremely high potential on portions of the spray gun over a period of time by draining the charge away to operate an indicator light, which is the other feature of the present invention.

According to this feature, a more visible signal that the electrostatic operation is in fact functioning properly is provided by the indicator light. The indicator light may be advantageously located away from the spray gun so that a protective cover placed over a portion of the spray gun will not obstruct the indicator light. In addition, the indicator light is visible not only to the operator of the spray gun, but also to others without them entering the spray painting booth.

Both the protection accorded to the operator from electrical discharge and the more visible signal of proper electrostatic operation are accomplished in an expeditious manner. The safety harness of the present invention may be manufactured at a very low cost, thereby making the solution of the present invention highly desirable from an economic standpoint. Finally, all of the aforesaid advantages and objectives are achieved without incurring any substantial relative disadvantage.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A safety harness for use with an electrostatic spray paint gun having a barrel and a paint tube connected thereto for supplying paint from a paint hose to a nozzle mounted on the barrel, said safety harness comprising:

a safety shield made of a T-shaped segment of nonconductive material having an inner surface and an outer surface, said segment being formed with extended arms and a base in the shape of the letter "T", the base of said T-shaped segment of nonconductive material being adapted for fitting around the paint tube of the spray gun when said safety harness is installed on the spray gun, the arms of the T-shaped segment of nonconductive material being adapted for fitting around the barrel of the spray gun when said safety harness is installed on the spray gun, said inner surface of said T-shaped segment of nonconductive material facing toward the paint tube and the barrel of the spray gun when said safety harness is installed on the spray gun;

a thin sheet of conductive foil secured to said inner surface of said T-shaped segment of nonconductive material so that said conductive foil will face the paint tube and the barrel of the spray gun when said safety harness is installed on the spray gun;

means for retaining the base of said T-shaped segment of nonconductive material in position around the paint tube of the spray gun when said safety harness is installed on the spray gun;

means for retaining the arms of the T-shaped segment of nonconductive material in position around the barrel of the spray gun when said safety harness is installed on the spray gun; and means for discharging an electrostatic charge from said conductive foil.

2. A safety harness as defined in claim 1, wherein said safety shield is made of a material from the group consisting of neoprene, vinyl, and nonconductive rubber.

3. A safety harness as defined in claim 1, in which said T-shaped segment includes a central portion and said base includes a top and sides with portions of the top located adjacent the sides, wherein the arms of the T-shaped segment of material are attached to the base of the T-shaped segment of material at the central portion of the T-shaped segment of material, the portions of the top of the base of the T-shaped segment of material adjacent the sides of the base of the T-shaped segment of material being separate from the arms of the T-shaped segment of material.

4. A safety harness as defined in claim 3, wherein the width of the portion of the base of the T-shaped segment of material which is attached to the arms of the T-shaped segment of material is only approximately a third of the width of the base of the T-shaped segment of material.

5. A safety harness as defined in claim 3, wherein the width of the arms of the T-shaped segment of material is sufficiently large to fit around the barrel of the spray gun with at least some overlap.

6. A safety harness as defined in claim 3, wherein the width of the base of the T-shaped segment of material is sufficiently large to fit around the paint tube of the spray gun with at least some overlap.

7. A safety harness as defined in claim 1, wherein said safety shield and said thin sheet of conductive material are both flexible 8. A safety harness as defined in claim 1, wherein said thin sheet of conductive material is made of copper.

9. A safety harness as defined in claim 8, wherein the adhesive used to secure said thin sheet of conductive material to said inner surface of said T-shaped segment of nonconductive material is silicone rubber.

10. A safety harness as defined in claim 1, wherein said thin sheet of conductive material is secured to said inner surface of said T-shaped segment of nonconductive material adhesively.

11. A safety harness as defined in claim 1 wherein said means for retaining the base of said T-shaped segment of nonconductive material comprises:

first retaining means located on one side of the base of said T-shaped segment of nonconductive material on said inner surface thereof; and second retaining means located on the other side of the base of said T-shaped segment of nonconductive material on said inner surface thereof.

12. A safety harness as defined in claim 11, wherein said first retaining means comprises a first mating strip adhesively secured to one side of the base of said T-shaped segment of nonconductive material on said inner surface thereof, and said second retaining means comprises a second mating strip adhesively secured to the other side of the base of said T-shaped segment of nonconductive material on said inner surface thereof.

13. A safety harness as defined in claim , wherein said first and second mating strips include releasable attaching means.

14. A safety harness as defined in claim 1 wherein said means for retaining the base of said T-shaped segment of nonconductive material comprises:

first retaining means located on one side of the base of said T-shaped segment of nonconductive material on said inner surface thereof; and second retaining means located on the other side of the base of said T-shaped segment of nonconductive material on said outer surface thereof.

15. A safety harness as defined in claim 1 wherein said means for retaining the arms of said T-shaped segment of nonconductive material comprises:

first retaining means located on the side of one of the arms of said T-shaped segment of nonconductive material on said inner surface thereof; and second retaining means located on the other of the arms of said T-shaped segment of nonconductive material on said outer surface thereof.

16. A safety harness as defined in claim 15, wherein said first retaining means comprises a first mating strip adhesively secured to the side of one of the arms of said T-shaped segment of nonconductive material on said inner surface thereof, and said second retaining means comprises a second mating strip adhesively secured to the other of the arms of said T-shaped segment of nonconductive material on said inner surface thereof.

17. A safety harness as defined in claim 16, wherein said first and second mating strips include releasable attaching means.

18. A safety harness as defined in claim 1, wherein said discharging means comprises:

a wire having a first end and a second end, said first end of said wire being electrically connected to said thin sheet of conductive foil; and an indicator light connected on one side thereof to said second end of said wire, and on the other side to ground, said indicator light being illuminated whenever the spray gun is generating an electrostatic field.

19. A safety harness as defined in claim 18, wherein said indicator light comprises a fluorescent tube.

20. A safety harness as defined in claim 18, wherein said indicator light comprises a neon bulb.

21. A safety harness as defined in claim 18, wherein said indicator light is located in a position remote from said spray gun where it will be highly visible.

22. A safety harness for use with an electrostatic spray paint gun having a barrel and a paint tube connected thereto for supplying paint from a paint hose to a nozzle mounted on the barrel, said safety harness comprising:

a safety shield made of a segment of nonconductive material having an inner surface and an outer surface, a first portion of said segment of nonconductive material being configured to fit around the paint tube of the spray gun when said safety harness is installed on the spray gun, a second portion of said segment of nonconductive material being configured to fit around the barrel of the spray gun when said safety harness is installed on the spray gun, said inner surface of said segment of nonconductive material facing toward the paint tube and the barrel of the spray gun when said safety harness is installed on the spray gun;

a thin sheet of conductive foil secured to said inner surface of said segment of nonconductive material so that said conductive foil will face toward the paint tube and the barrel of the spray gun when said safety harness is installed on the spray gun;

a first mating strip adhesively secured to one side of the first portion of said segment of nonconductive material on said inner surface thereof;

a second mating strip adhesively secured to the other side of the first portion of said segment of nonconductive material on said inner surface thereof, said first and second mating strips including releasable attaching means for retaining the first portion of said segment of nonconductive material in position around the paint tube of the spray gun when said safety harness is installed on the spray gun;

a third mating strip adhesively secured to the edge of the second portion of said segment of nonconductive material on said inner surface thereof;

a fourth mating strip adhesively secured to the other edge of the second portion of said segment of nonconductive material on said outer surface thereof, said third and fourth mating strips including releasable attaching means for retaining the second portion of the segment of nonconductive material in position around the barrel of the spray gun when said safety harness is installed on the spray gun; and a wire having a first end and a second end, said first end of said wire being electrically connected to said thin sheet of conductive foil; and an indicator light connected on one side thereof to said second end of said wire, and on the other side to ground, said indicator light thus discharging an electrostatic charge from said conductive foil and being illuminated whenever the spray gun is generating an electrostatic field.

23. A safety harness for use with an electrostatic spray paint gun having a barrel and a paint tube connected thereto, said safety harness comprising:

a safety shield made of a segment of nonconductive material, a first portion of said segment of nonconductive material being configured for fitting around the paint tube of the spray gun, a second portion of the segment of nonconductive material being configured for fitting around the barrel of the spray gun;

a thin sheet of conductive foil secured to the side of said segment of nonconductive material facing the paint tube and the barrel of the spray gun;

means for retaining said safety shield in position around the paint tube and the barrel of the spray gun when said safety harness is installed on the spray gun; and means for discharging an electrostatic charge from said conductive foil.

24. A method of providing a safety shield for use with an electrostatic spray paint gun having a barrel and a paint tube connected thereto for supplying paint from a paint hose to a nozzle mounted on the barrel, said method comprising:

securing a thin sheet of conductive foil to one side of a safety shield made of a T-shaped segment of nonconductive material, said segment being formed with extended arms and a base in the shape of the letter "T";

fitting the base of said T-shaped segment of nonconductive material around the paint tube of the spray gun, with said conductive foil on said one side of said safety shield facing the paint tube of the spray gun;

retaining the base of said T-shaped segment of nonconductive material in position around the paint tube of the spray gun;

fitting the arms of the T-shaped segment of nonconductive material around the barrel of the spray gun, with said conductive foil on said one side of said safety shield facing the barrel of the spray gun;

retaining the arms of the T-shaped segment of nonconductive material in position around the barrel of the spray gun; and discharging an electrostatic charge from said conductive foil.

25. A method as defined in claim 24, wherein said discharging step comprises:

electrically connecting a first end of a wire to said thin sheet of conductive foil; and electrically connecting the other end of said wire to one side of an indicator light, the other side of said indicator light being connected to ground, said indicator light being illuminated whenever the spray gun is generating an electrostatic field.

26. A safety harness for use with an electrostatic spray paint gun having exposed metal components, said safety harness comprising:

a safety shield formed of a sheet of material having a pair of opposed surfaces, said sheet being shaped to matingly fit adjacent a selected exposed metal component of the spray paint gun with one of said surfaces being in electrically conducting contact with said selected component;

electrically conducting means distributed across said one surface of the sheet;

means for releasably securing said safety shield in place with said one surface in electrically conducing contact with said selected exposed metal component; and discharge means electrically connected to said distributed electrically conducting means for bleeding off electrostatic charge tending to build up on said selected exposed metal component.

27. The safety harness of claim 26 wherein said sheet comprises non-conductive material for insulating and protecting the user of the spray paint gun from exposure to electrostatic charge.

28. The safety harness of claim 27 wherein said metal components include a barrel and a paint tube and said sheet comprising non-conductive material is shaped to fit around said paint tube.

29. The safety harness of claim 28 wherein said sheet comprising non-conductive material further includes a portion which is shaped to fit around the barrel of said spray paint gun.

30. The safety harness of claim 29 further comprising a thin sheet of conductive foil adhesively affixed to said one surface of said sheet comprising non-conductive material in position to electrically contact both the barrel and the paint tube of said spray paint gun when the safety shield is in position around both of said barrel and said paint tube.

31. The safety harness of claim 26 wherein said distributed electrical conducting means comprise a thin sheet of conductive foil adhesively affixed to selected portions of said one surface.

32. The safety harness of claim 26 wherein said discharge means comprise an indicator light selectively positioned at a location remote from said spray gun in order to be visible to personnel other than the user of the spray paint gun.

33. The safety harness of claim 32 wherein said light comprises a fluorescent tube having one terminal which is connected to a reference potential.

34. The safety harness of claim 32 wherein said light comprises at least one neon lamp having one terminal which is connected to a reference potential.

* * * * *